United States Patent [19]

Matovich et al.

[11] Patent Number: 4,637,858

[45] Date of Patent: Jan. 20, 1987

[54] PYROLYSIS OF BLACK LIQUOR AT HIGH TEMPERATURES USING RADIANT ENERGY

[75] Inventors: Edwin Matovich, Dana Point, Calif.; Robert J. Spannuth, Washougal, Wash.

[73] Assignee: Crown Zellerbach Corporation, San Francisco, Calif.

[21] Appl. No.: 705,156

[22] Filed: Feb. 25, 1985

[51] Int. Cl.[4] ..... D21C 11/12; D21C 11/00

[52] U.S. Cl. ..... 162/30.1; 162/30.11; 423/DIG. 3; 423/207

[58] Field of Search ..... 162/30.1, 30.11, 29; 423/207, DIG. 3

[56] References Cited

U.S. PATENT DOCUMENTS

| | | | |
|---|---|---|---|
| 3,607,619 | 9/1971 | Hess et al. | 162/30.11 |
| 3,762,989 | 10/1973 | Timpe | 162/30.11 |
| 3,862,909 | 1/1975 | Copeland | 162/30.11 |
| 4,095,974 | 6/1978 | Matovich | 423/345 |
| 4,208,245 | 6/1980 | Watkins et al. | 423/207 |

FOREIGN PATENT DOCUMENTS

| | | | |
|---|---|---|---|
| 678130 | 1/1964 | Canada | 423/207 |
| 787293 | 6/1968 | Canada | 423/207 |
| 2027094 | 12/1970 | Fed. Rep. of Germany | 162/30 |
| 42-801 | 1/1967 | Japan | 162/30.11 |
| 1066903 | 4/1967 | United Kingdom | 423/207 |

*Primary Examiner*—S. Leon Bashore
*Assistant Examiner*—K. M. Hastings
*Attorney, Agent, or Firm*—Stanley M. Teigland

[57] ABSTRACT

This invention is a process for recovering sodium hydroxide directly from black liquor. The process involves pyrolyzing the black liquor in the absence of oxygen to produce a product containing sodium carbide, and hydrolyzing the sodium carbide to form sodium hydroxide. The pyrolysis is carried out at about 4000° F. using radiant energy.

5 Claims, 2 Drawing Figures

PYROLYSIS OF BLACK LIQUOR AT HIGH TEMPERATURES USING RADIANT ENERGY

BACKGROUND OF THE INVENTION

In the alkaline pulping process, wood chips are digested in an aqueous pulping liquor containing sodium hydroxide. If the liquor also contains sodium sulfide, the process is kraft. After digestion is complete, the spent liquor (called black liquor) is concentrated by evaporation. The organic matter in the concentrated black liquor is then burned and the resulting smelt is dissolved in water to produce green liquor, which contains sodium carbonate. After being clarified, the green liquor is causticized by combining it with lime (calcium oxide) to convert the sodium carbonate to sodium hydroxide. The causticized liquor (called white liquor) is then used to digest more wood. This invention provides a more direct process for removing the organic matter in spent pulping liquor and regenerating the inorganic chemical values in the liquor.

SUMMARY OF THE INVENTION

In this invention the spent pulping liquor is converted directly into reusable pulping liquor containing sodium hydroxide. The invention involves pyrolyzing the liquor in the substantial absence of oxygen gas to produce a solid product containing sodium carbide and then quenching the product in water to produce the reusable liquor containing sodium hydroxide.

The liquor is preferably pyrolyzed by passing it through a zone of radiant energy having a temperature of at least 3000° F., preferably between about 3500° and 4500° F. The radiant energy preferably has a wave length in the near infrared region. The wave length is preferably between about one and two microns. Apparatus for providing a suitable zone of radiant energy is described in U.S. Pat. No. 4,095,974, which is incorporated herein by reference.

When subjected to near-infrared radiation, the carbon present in spent pulping liquor absorbs energy and reacts with, or promotes the reaction of, other chemicals in the liquor. For example, sodium carbonate is essentially transparent to radiation in the near-infrared region, and therefore would normally pass through the reaction zone unchanged, but when contacted with carbon black, the sodium carbonate decomposes into sodium oxide and carbon dioxide in accordance with the following equation:

$$Na_2CO_3 \rightarrow Na_2O + CO_2$$

The sodium oxide reacts with the carbon to produce sodium carbide and carbon monoxide in accordance with the following equation:

$$Na_2O + 3C \rightarrow Na_2C_2 + CO$$

And the carbon dioxide also reacts with the carbon to produce additional carbon monoxide in accordance with the following equation:

$$CO_2 + C \rightarrow 2CO$$

Sodium sulfate present in the spent pulping liquor from the kraft process is reduced by carbon to sodium sulfide and carbon monoxide as follows:

$$Na_2SO_4 + 4C \rightarrow Na_2S + 4CO$$

Water in the pulping liquor reacts with the sodium oxide and carbon monoxide to produce sodium carbonate and hydrogen in accordance with the following equation:

$$H_2O + Na_2O + CO \rightarrow Na_2CO_3 + H_2$$

This reconversion of sodium oxide to sodium carbonate detracts from the desired formation of sodium carbide. However, excess carbon will react with water to remove it from the system in accordance with the following equation:

$$C + H_2O \rightarrow CO + H_2$$

It is apparent from these reactions that it is desirable to have a stoichiometric excess of carbon and a minimal amount of water present. Hence, before the liquor is pyrolyzed, it is preferably concentrated so that it contains not more than about twenty-five percent water. To ensure a stoichiometric excess of carbon, a source of carbon, such as carbon black or sawdust, may be added to the liquor if desired. In any event, it is desirable to recycle to the reaction zone carbon present in the pyrolysis product.

The pyrolysis product contains sodium carbide, which is pyrophoric, so it should not be exposed to oxygen gas before being quenched with water. The sodium carbide reacts with the water to form sodium hydroxide and acetylene in accordance with the following equation:

$$Na_2C_2 + 2H_2O \rightarrow 2NaOH + C_2H_2$$

The solid product leaving the zone of radiant energy may be separated from the gaseous product, such as by a cyclone, before the solid product is quenched with water, or the water may be added to the cyclone. The acetylene generated by the addition of water becomes part of the gaseous product, which may be used as a fuel gas.

DETAILED DESCRIPTION

Figure 1:
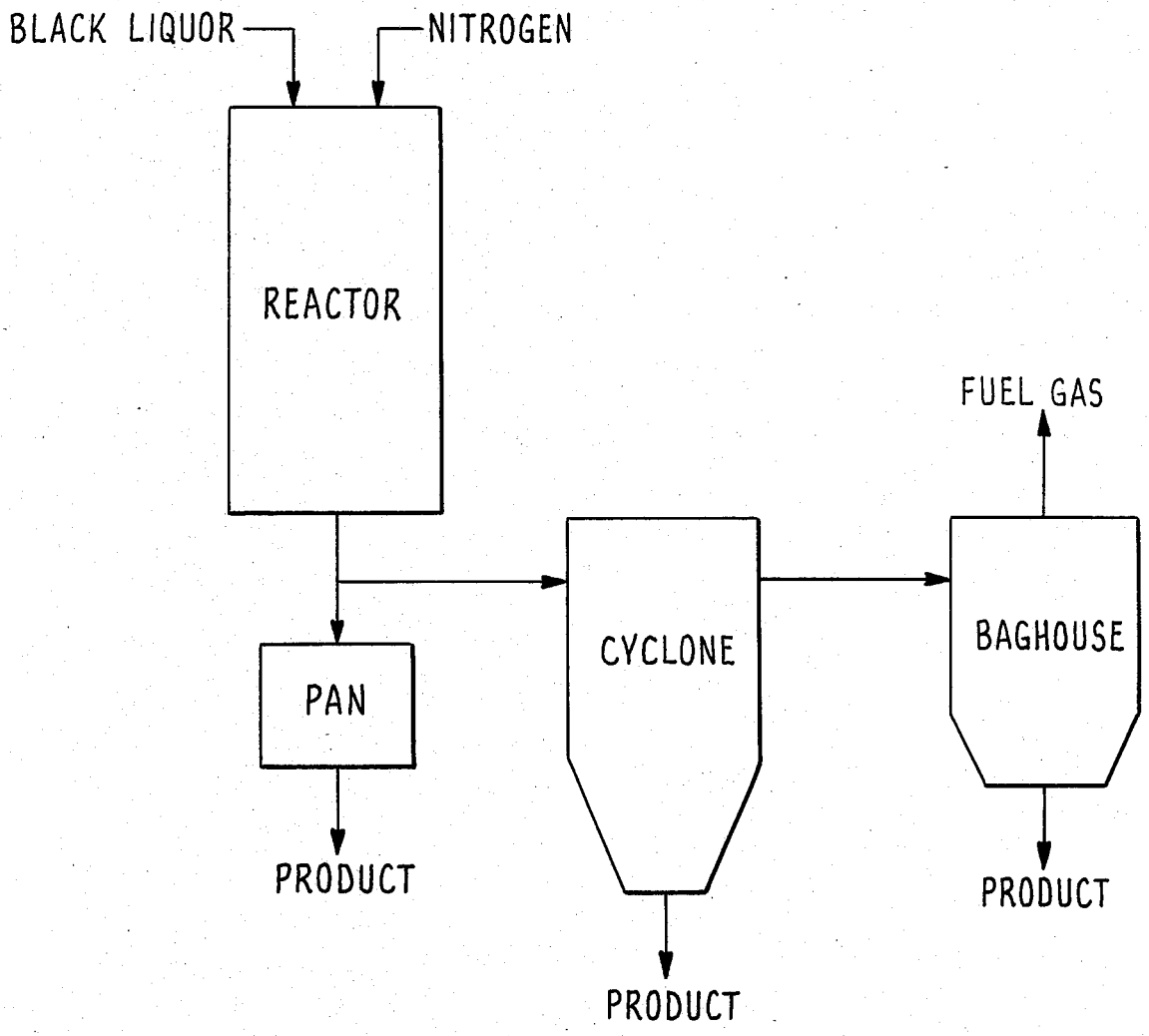
FIG. 1 is a block flow diagram of an embodiment of the process of this invention that was carried out experimentally.

Referring to the drawings, black liquor is fed to a reactor in which the liquor is pyrolyzed. A preferred reactor is shown in FIGS. 2A–6 of U.S. Pat. No. 4,095,974. As described therein, the reactor has a source of radiant energy, such as electrical resistance heating elements, which direct high-intensity radiant energy toward a reaction zone. The radiation is in the near-infrared region, and has a wave length of about one micron. An inert gas such as nitrogen is introduced into the reactor to provide an annular fluid wall surrounding the reaction zone. As the black liquor falls through the reaction zone, it absorbs radiant energy and is pyrolyzed in less than about one second.

The pyrolyzed material consists of solid product and gaseous product. The gaseous product may be drawn off and fed to a cyclone before the solid product drops into a water bath, as shown in FIG. 1. The cyclone removes larger particles of solid product entrained with the gaseous product before the gaseous product is fed to a baghouse, which removes finer particles of the solid product. The gas leaving the baghouse, which comprises principally carbon monoxide and minor amounts of carbon dioxide, hydrogen, and hydrocarbon gases, may be used as a fuel gas. The solid product leaving the baghouse may be combined with the product leaving the cyclone and the water bath to produce a recyclable pulping liquor.

Figure 2:
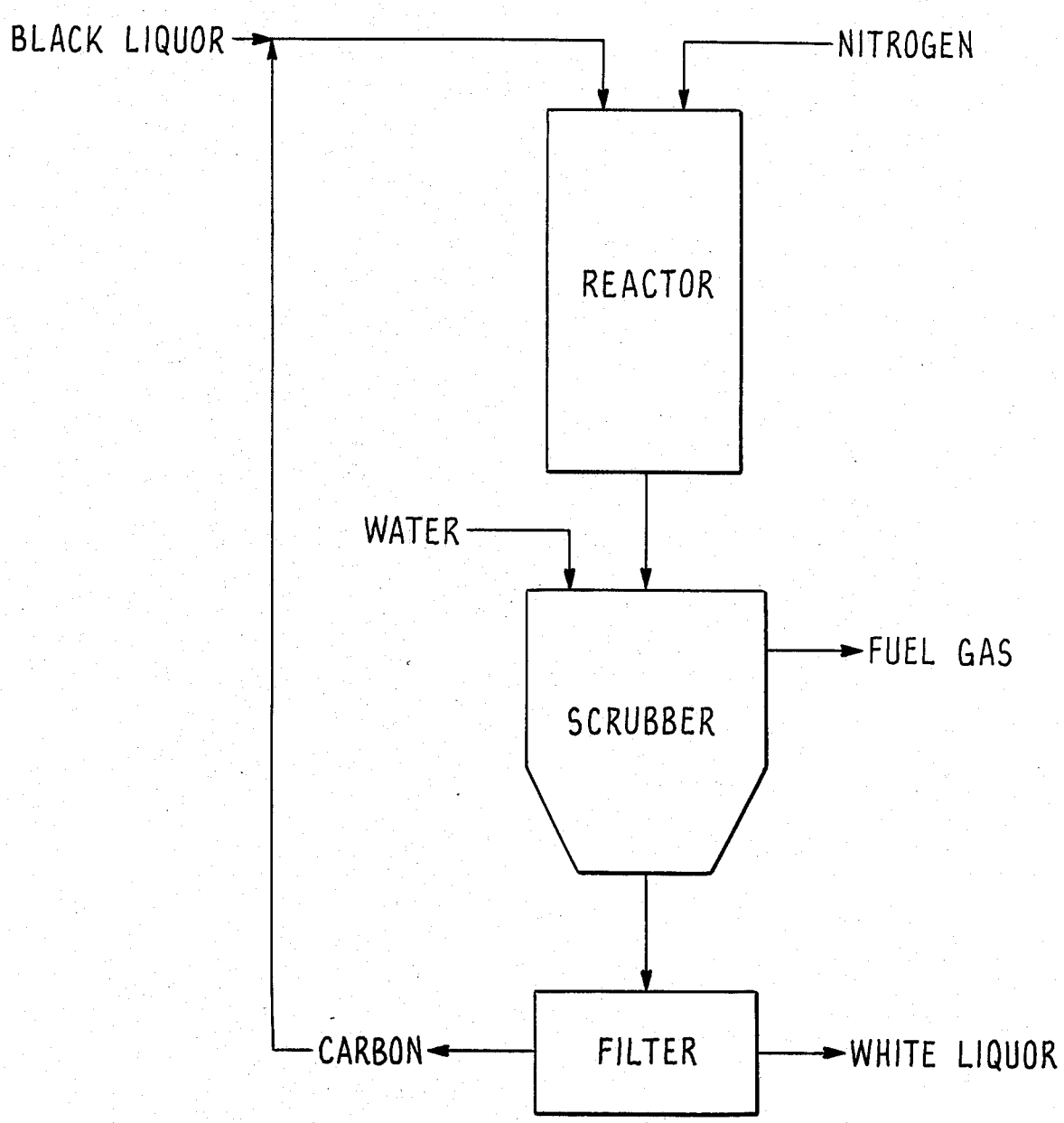
FIG. 2 is a block flow diagram of an embodiment of the process of this invention that represents the best mode contemplated for practicing the invention.

FIG. 1 represents an embodiment of the process of the invention that was carried out experimentally. In a commercial operation, it is preferable to feed the pyrolysis product to a scrubber, as shown in FIG. 2. Water is introduced into the scrubber to separate the solid product from the gaseous product. The scrubbed gas is withdrawn as a fuel gas. The wetted solid product is withdrawn from the scrubber as a reusable pulping liquor containing sodium hydroxide resulting from reaction of the water with sodium carbide in the solid product. Insoluble material in the liquor, such as carbon, may be removed, such as by a filter, and recycled to the reactor.

This invention is applicable to any alkaline pulping process, i.e., any process using sodium hydroxide, but it is especially applicable to the kraft pulping process, which uses sodium sulfide in addition to sodium hydroxide.

The following example was carried out in accordance with the embodiment shown in FIG. 1. The reactor is shown in FIGS. 2A-6 of U.S. Pat. No. 4,095,974.

EXAMPLE

A mixture of about 84% by weight of dry black liquor (93% solids), 8% by weight of wood flour (about 10% moisture) and 8% by weight of carbon black was prepared. The mixture, which was free-flowing, was introduced into the reactor at a rate of 0.55 pounds per minute over a period of 20 minutes, for a total input of 11.0 pounds. Nitrogen was introduced into the reactor at a rate of 29.7 standard cubic feet per minute. The temperature inside the reactor was about 4000° F.

Pyrolyzed samples were collected at three points: a water-filled pan directly below the reactor, collecting approximately 50% of the total output sample; a water-filled cyclone collecting 20% of the sample, and a baghouse dropping its product into a water bath, representing 30% of the total output sample.

Collection of the pan solution was hampered by the floating of particulate material atop the water. This particulate material spontaneously ignited before it could be completely submerged, so the result of that portion of the sample may be biased in favor of a high $Na_2CO_3$ reading.

Analysis of the sodium content of the three solutions for $Na_2S$, NaOH, and $Na_2CO_3$ were made.

| Percent of total Na in each sample as | | | |
|---|---|---|---|
| | $Na_2S$ | NaOH | $Na_2CO_3$ |
| Pan | 14.8 | 23.3 | 59.8 |
| Cyclone | 41.0 | 40.3 | 18.7 |
| Baghouse | 38.5 | 48.8 | 12.7 |

| Weighted percentage of Na in total sample (Pan = 50%, Cyclone = 20%, Baghouse = 30%) | |
|---|---|
| $Na_2S$ | 27.5 |
| NaOH | 34.4 |
| $Na_2CO_3$ | 37.5 |

It can be seen from this example that even with the $Na_2CO_3$ bias in collecting the product, almost 62% of the sodium was present as sodium sulfide and sodium hydroxide.

We claim:

1. A method of converting spent alkaline pulping liquor to reusable pulping liquor containing sodium hydroxide, which method comprises pyrolyzing the pulping liquor by passing the pulping liquor through a zone of radiant energy having a wave length in the near-infrared region and a temperature of at least 3000° F. in the substantial absence of oxygen under conditions such that a solid product containing sodium carbide is produced, and quenching the solid product, before the solid product contacts oxygen gas, in water in order to convert the sodium carbide directly to sodium hydroxide, whereby a reusable pulping liquor containing sodium hydroxide is produced.

2. The method of claim 1 wherein carbon present in the quenched solid product is removed from the solid product and recycled to the zone of radiant energy.

3. The method of claim 1 wherein the pulping liquor is concentrated to a water content of not more than about 25 percent by weight before it is pyrolyzed.

4. The method of claim 3 wherein a source of carbon is added to the pulping liquor before it is pyrolyzed.

5. The method of claim 1 wherein the spent pulping liquor is black liquor resulting from the kraft pulping process.

* * * * *